US010683562B2

(12) United States Patent
Hosono et al.

(10) Patent No.: US 10,683,562 B2
(45) Date of Patent: Jun. 16, 2020

(54) REDUCED IRON MANUFACTURING METHOD

(71) Applicant: Kobe Steel, Ltd., Kobe-shi (JP)

(72) Inventors: Yui Hosono, Kobe (JP); Masaki Shimamoto, Kobe (JP); Takao Harada, Kobe (JP); Shingo Yoshida, Kobe (JP); Shoichi Kikuchi, Kobe (JP); Taiji Hatakeyama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 177 days.

(21) Appl. No.: 15/577,151

(22) PCT Filed: Apr. 26, 2016

(86) PCT No.: PCT/JP2016/062957
§ 371 (c)(1),
(2) Date: Nov. 27, 2017

(87) PCT Pub. No.: WO2016/190023
PCT Pub. Date: Dec. 1, 2016

(65) Prior Publication Data

US 2018/0209012 A1 Jul. 26, 2018

(30) Foreign Application Priority Data

May 28, 2015 (JP) ..... 2015-108559

(51) Int. Cl.
*C22B 1/24* (2006.01)
*C22B 1/245* (2006.01)
*C21B 13/00* (2006.01)

(52) U.S. Cl.
CPC ..... *C22B 1/24* (2013.01); *C21B 13/00* (2013.01); *C22B 1/245* (2013.01)

(58) Field of Classification Search
CPC ..... C22B 1/24; C22B 13/00; C21B 13/00
See application file for complete search history.

(56) References Cited

U.S. PATENT DOCUMENTS 3,993,471 A * 11/1976 Yoshimura ..... C21B 13/0046 75/762
7,815,710 B2 * 10/2010 Ibaraki ..... C21B 13/0046 75/484

(Continued)

FOREIGN PATENT DOCUMENTS

CN 103509940 B * 4/2015
JP 11-12626 A 1/1999

(Continued)

OTHER PUBLICATIONS

JP-2009024240-A machine translation (Year: 2009).*

(Continued)

*Primary Examiner* — Tima M. McGuthry-Banks
(74) *Attorney, Agent, or Firm* — Oblon, McClelland, Maier & Neustadt, L.L.P.

(57) ABSTRACT

The reduced iron manufacturing method of the present invention includes preparing an agglomerate by agglomerating a mixture containing an iron oxide-containing substance and a carbonaceous reducing agent, and preparing reduced iron by heating the agglomerate to reduce iron oxide in the agglomerate, characterized in that Expression (I) as follows is satisfied:

$$C_{fix} \times X_{under105} / O_{FeO} \leq 51 \quad \text{(I)}$$

where $O_{FeO}$ is the mass percentage of oxygen contained in the iron oxide in the agglomerate, $C_{fix}$ is the mass percentage of total fixed carbon contained in the agglomerate, and $X_{under105}$ is the mass percentage of particles having a particle diameter of 105 μm or less with respect to the total mass of particles configuring the carbonaceous reducing agent.

14 Claims, 5 Drawing Sheets

(56) References Cited

U.S. PATENT DOCUMENTS

| | | | |
|---|---|---|---|
| 8,690,988 | B2 | 4/2014 | Iwasaki |
| 2006/0169103 | A1 | 8/2006 | Ito et al. |
| 2010/0171072 | A1 | 7/2010 | Kudo et al. |
| 2011/0023656 | A1 | 2/2011 | Kunii et al. |
| 2011/0024681 | A1 | 2/2011 | Sugiyama et al. |
| 2011/0265603 | A1 | 11/2011 | Sugiyama et al. |

FOREIGN PATENT DOCUMENTS

| | | | | |
|---|---|---|---|---|
| JP | 2003-13125 | A | | 1/2003 |
| JP | 2004-285399 | A | | 10/2004 |
| JP | 2008-95177 | A | | 4/2008 |
| JP | 2009-7619 | A | | 1/2009 |
| JP | 2009024240 | A | * | 2/2009 |
| JP | 2009-270193 | A | | 11/2009 |
| JP | 2009-270198 | A | | 11/2009 |
| JP | 2010-189762 | A | | 9/2010 |
| JP | 2013-36058 | A | | 2/2013 |
| JP | 2013-142167 | A | | 7/2013 |
| JP | 2013-174001 | A | | 9/2013 |
| JP | 2014-62321 | A | | 4/2014 |

OTHER PUBLICATIONS

CN 103509940 B Machine Translation + Abstract (Year: 2015).*

International Preliminary Report on Patentability and Written Opinion dated May 24, 2016 in PCT/JP2016/062957 (submitting English translation only).

International Search Report dated May 24, 2016, in PCT/JP2016/062957 filed Apr. 26, 2016.

* cited by examiner

REDUCED IRON MANUFACTURING METHOD

TECHNICAL FIELD

The present invention relates to a method for manufacturing reduced iron by heating an agglomerate containing an iron oxide source such as iron ore (which may hereafter be referred to as "iron oxide-containing substance") and a carbonaceous reducing agent containing carbon such as coal, so as to reduce iron oxide in the agglomerate.

BACKGROUND ART

The direct reduction iron-making method is developed as a method for manufacturing reduced iron by reducing iron oxide contained in an iron oxide-containing substance.

For industrial implementation of the above direct reduction iron-making method, there are a lot of issues that must be addressed, such as improvement in operation stability, economical efficiency, and reduced iron quality. The techniques of Patent Literatures 1 to 9 are proposed as an attempt to address such issues.

Among the above issues, improvement in the yield of reduced iron is particularly considered important in recent years. This is because, when the yield is poor, the costs rise and thus production in an industrial scale cannot be made. The techniques of Patent Literatures 10 and 11 are proposed as an attempt to improve the yield of reduced iron.

Patent Literature 10 (JP 2014-62321 A) discloses use of a carbonaceous reducing agent having an average particle diameter of 40 to 160 μm and containing 2 mass % or more of particles having a particle diameter of 400 μm or more.

As another attempt, Patent Literature 11 (U.S. Pat. No. 8,690,988), for example, discloses an agglomerate containing a first carbonaceous reducing agent having a size less than 48 mesh and a second carbonaceous reducing agent having a size between 3 to 48 mesh and having an average particle diameter larger than the average particle diameter of the first carbonaceous reducing agent. Herein, the first carbonaceous reducing agent is contained at 65% to 95% of the stoichiometric ratio that is needed for making the iron oxide-containing substance into reduced iron, and the second carbonaceous reducing agent is contained at 20% to 60% of the stoichiometric ratio that is needed for making the iron oxide-containing substance into reduced iron.

CITATION LIST

Patent Literature

Patent Literature 1: JP 2003-13125 A
Patent Literature 2: JP 2004-285399 A
Patent Literature 3: JP 2009-7619 A
Patent Literature 4: JP 2009-270193 A
Patent Literature 5: JP 2009-270198 A
Patent Literature 6: JP 2010-189762 A
Patent Literature 7: JP 2013-142167 A
Patent Literature 8: JP 2013-174001 A
Patent Literature 9: JP 2013-36058 A
Patent Literature 10: JP 2014-62321 A
Patent Literature 11: U.S. Pat. No. 8,690,988

SUMMARY OF INVENTION

The agglomerate disclosed in Patent Literature 10 can improve the yield of reduced iron having a large particle diameter by containing a carbonaceous reducing agent having a particle diameter of 400 μm or more. However, when a carbonaceous reducing agent having a particle diameter of 400 μm or more is used, it may be difficult to prepare an agglomerate before heating.

In the agglomerate disclosed in Patent Literature 11, carbonaceous reducing agents having two types of particle diameters must be prepared, so that two machines must be provided as equipment for pulverizing the carbonaceous reducing agents. This leads to a disadvantage of increase in the costs of the production equipment.

The present invention has been made in view of the aforementioned circumstances, and an object thereof is to provide a reduced iron manufacturing method having high productivity.

A reduced iron manufacturing method of the present invention includes preparing an agglomerate by agglomerating a mixture containing an iron oxide-containing substance and a carbonaceous reducing agent, and preparing reduced iron by heating the agglomerate to reduce iron oxide in the agglomerate, characterized in that Expression (I) as follows is satisfied, where $O_{FeO}$ is the mass percentage of oxygen contained in the iron oxide in the agglomerate, $C_{fix}$ is the mass percentage of total fixed carbon contained in the agglomerate, and $X_{under105}$ is the mass percentage of particles having a particle diameter of 105 μm or less with respect to the total mass of particles configuring the carbonaceous reducing agent.

$$C_{fix} \times X_{under105} / O_{FeO} \leq 51 \quad \text{(I)}$$

DESCRIPTION OF EMBODIMENTS

Figure 1:
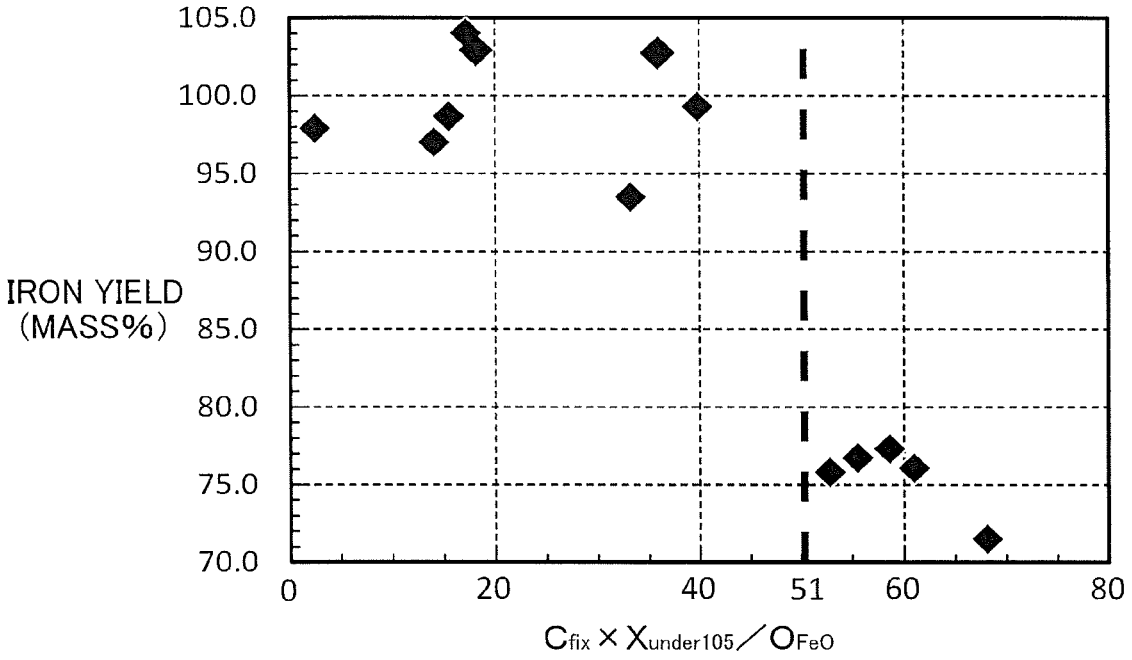
FIG. 1 is a graph showing correlation between $C_{fix} \times X_{under105}/O_{FeO}$ and iron yield (mass %) of each of the Examples and Comparative Examples, where the longitudinal axis represents the iron yield (mass %) and the lateral axis represents $C_{fix} \times X_{under105}/O_{FeO}$.

In order to achieve the aforementioned object, the present inventors have made researches on a relationship between the amount of oxygen contained in iron oxide in an agglomerate and the amount and particle diameter of a carbonaceous reducing agent in the agglomerate. As a result, it has been made clear that, when the amount of the carbonaceous reducing agent in the agglomerate is excessive relative to the amount of oxygen contained in iron oxide in the agglomerate, that is, when fixed carbon is contained in an amount exceeding the amount of carbon needed for reduction of the iron oxide, the reduced iron is not sufficiently aggregated, so that the yield of reduced iron decreases.

It was conventionally believed that, according as the carbonaceous reducing agent is pulverized more finely, the particle diameter of the obtained reduced iron increases. However, it has been found out that, when the particle diameter of the carbonaceous reducing agent is small, the reduced iron is less likely to be sufficiently aggregated even when the amount of the carbonaceous reducing agent is adjusted. This is considered to be because, by the presence of the carbonaceous reducing agent having a small particle diameter between the iron oxide particles, the reduced iron cannot penetrate between the iron oxide particles, thereby hindering the aggregation of the reduced iron.

Thus, the present inventors have repeated eager studies on a relationship between the particle diameter of the carbonaceous reducing agent, the total amount of fixed carbon contained in the agglomerate, and the amount of oxygen contained in the iron oxide in the agglomerate. As a result, the present inventors have found out that the reduced iron penetrates more readily between the particles of the carbonaceous reducing agent when the ratio of the carbonaceous reducing agent having a particle diameter of 105 μm or less is reduced, that the reduced iron is aggregated more readily when the mass percentage of the total amount of fixed carbon contained in the agglomerate is reduced, and that the yield of the reduced iron is improved according as the amount of oxygen contained in the iron oxide in the agglomerate is larger, thereby to complete the present invention shown below.

Hereinafter, a reduced iron manufacturing method of the present invention will be described in detail.

The reduced iron manufacturing method of the present invention includes a step for preparing an agglomerate by agglomerating a mixture containing an iron oxide-containing substance and a carbonaceous reducing agent (which may be hereafter also referred to as "agglomeration step"), and a step for preparing reduced iron by heating the agglomerate to reduce the iron oxide in the agglomerate (which may be hereafter also referred to as "reduction step"). Further, the method is characterized in that Expression (I) as follows is satisfied, where $O_{FeO}$ is the mass percentage of oxygen contained in the iron oxide in the agglomerate, $C_{fix}$ is the mass percentage of the total fixed carbon contained in the agglomerate, and $X_{under105}$ is the mass percentage of particles having a particle diameter of 105 μm or less with respect to the total mass of particles configuring the carbonaceous reducing agent.

$$C_{fix} \times X_{under105} / O_{FeO} \leq 51 \quad \text{(I)}$$

When Expression (I) as above is satisfied, the reduced iron penetrates more readily between the particles of the carbonaceous reducing agent, and the reduced iron is aggregated more readily. This allows the reduced iron to coalesce with each other, and the rate of collection of coarse reduced iron having a diameter of 3.35 mm or more can be increased. The left side of Expression (I) as above is more preferably 45 or less, further more preferably 40 or less. A method for making the left side of Expression (I) as above be 51 or less is not particularly limited. For example, the mass percentage $C_{fix}$ of the total fixed carbon contained in the agglomerate may be decreased; the mass percentage $O_{FeO}$ of oxygen contained in the iron oxide in the agglomerate may be increased; the mass percentage $X_{under105}$ of particles having a particle diameter of 105 μm or less among the particles configuring the carbonaceous reducing agent may be decreased; or a combination of these techniques may be employed. Also, in order to make the left side of Expression (I) as above be 51 or less, the amount of blending the iron oxide-containing substance and the carbonaceous reducing agent may be adjusted in accordance with the particle size distribution of the carbonaceous reducing agent.

The "mass percentage $C_{fix}$ of the total fixed carbon contained in the agglomerate" in Expression (I) is calculated by a sum of the mass percentage of the fixed carbon contained in the carbonaceous reducing agent and, when a binder is contained, the mass percentage of the fixed carbon contained in the binder. As the mass percentage of the fixed carbon contained in the carbonaceous reducing agent, a value calculated by the fixed carbon mass fraction calculation method defined in JIS M8812 is adopted. The mass percentage of the fixed carbon contained in the binder can be calculated by a method similar to that of the fixed carbon contained in the carbonaceous reducing agent.

The "mass percentage $O_{FeO}$ of oxygen contained in iron oxide in the agglomerate" in Expression (I) is calculated by a sum of the mass percentage of oxygen contained in iron oxide in the iron oxide-containing substance and the mass percentage of oxygen contained in iron oxide in the ash among the components of the carbonaceous reducing agent. The iron oxide in the agglomerate is contained as magnetite ($Fe_3O_4$) or hematite ($Fe_2O_3$), so that the content ratios of these are specified and thereafter converted into the mass percentages of oxygen contained in the respective iron oxides, whereby the mass percentage of oxygen contained in the iron oxide is calculated. As the ratio of ash contained in the carbonaceous reducing agent, a value quantitated by the ash quantitation method defined in JIS M8812 is adopted. As the ratio of iron oxide in the ash, a value quantitated by the high-frequency inductively coupling (ICP: Inductively Coupled Plasma) emission spectrophotometry method is adopted.

The "mass percentage $X_{under105}$ of particles having a particle diameter of 105 μm or less among the particles configuring the carbonaceous reducing agent" in Expression (I) is a value obtained by measuring the particle size distribution of the carbonaceous reducing agent with use of a laser diffraction type particle size distribution measurement apparatus (Microtrack FRA9220 manufactured by Leads and Northrup Co.) and calculating the mass % of the mass of particles having a Volume-average particle diameter of 105 lira or less with respect to the mass of the total particles. In the measurement performed by the above measurement apparatus, a value of volume percentage is calculated, but it is assumed that the volume percentage is equal to the mass percentage.

Each of the steps configuring the reduced iron manufacturing method of the present invention will be described.

[Agglomeration Step]

In the agglomeration step, a mixture containing an iron oxide-containing substance and a carbonaceous reducing agent is agglomerated to prepare an agglomerate.

The mixture can be obtained by mixing raw material powders such as an iron oxide-containing substance and a carbonaceous reducing agent with use of a mixer. Either one of or both of a melting-point adjuster and a binder may be further added into the mixture.

The mixer for preparing the mixture may be either one of a rotary container type or a fixed container type. The mixer of rotary container type may be, for example, a rotary cylinder type mixer, a double circular cone type mixer, or a V-shaped mixer. The mixer of fixed container type may be, for example, a mixing tank having a rotary blade such as a spade provided in the inside.

<Agglomerate>

The agglomerate is prepared with use of an agglomerating machine that agglomerates the mixture. The agglomerating machine that can be used may be, for example, a plate-type granulating machine, a cylindrical type granulating machine, a double-roll type briquette molding machine, or the like. The shape of the agglomerate is not particularly limited and may be, for example, a pellet, a briquette, or the like. A method of molding the agglomerate that can be used may be, for example, pellet molding, briquette molding, extrusion molding, or the like.

The size of the agglomerate is not particularly limited, but the agglomerate preferably has a particle diameter of 50 mm or less, more preferably a particle diameter of 40 mm or less. When the agglomerate having such a particle diameter is used, the granulation efficiency can be enhanced, and moreover, heat can be readily transferred over the whole agglomerate at the time of heating. On the other hand, the agglomerate preferably has a particle diameter of 5 mm or more, more preferably a particle diameter of 10 mm or more. Having such a particle diameter facilitates handing of the agglomerate.

<Iron Oxide-Containing Substance>

The iron oxide-containing substance contains iron oxide such as magnetite ($Fe_3O_4$) and hematite ($Fe_2O_3$), and produces reduced iron by being heated together with the carbonaceous reducing agent in a heating step carried out later. The $O_{FeO}$ in Expression (I) (the mass percentage of oxygen contained in the iron oxide in the agglomerate) can be adjusted by increasing or decreasing the ratio of the iron oxide-containing substance. Such an iron oxide-containing substance that can be used may be, for example, iron ore, iron sand, dust resulting from steel production, residue resulting from non-ferrous smelting, waste product resulting from steel production, or the like. As the iron ore, it is preferable to use, for example, a hematite ore produced in Australia or India.

The iron oxide-containing substance is preferably pulverized in advance before being mixed, and is more preferably pulverized so that the average particle diameter may be 10 to 60 μm. A method for pulverizing the iron oxide-containing substance is not particularly limited, and known means such as a vibration mill, a roll crusher, or a ball mill can be adopted.

<Carbonaceous Reducing Agent>

The carbonaceous reducing agent reduces the iron oxide contained in the iron oxide-containing substance, and is added for supplying fixed carbon to the agglomerate. The $C_{fix}$ in Expression (I) (the mass percentage of the total fixed carbon contained in the agglomerate) can be adjusted by increasing or decreasing the ratio of the carbonaceous reducing agent. The carbonaceous reducing agent that can be used may be, for example, coal, cokes, dust resulting from steel production, or the like.

The carbonaceous reducing agent is preferably added so that the atomic molar ratio ($O_{FeO}/C_{fix}$) of the oxygen atoms $O_{FeO}$ contained in the iron oxide in the agglomerate with respect to the total fixed carbon $C_{fix}$ contained in the agglomerate may be 0.8 or more to 2 or less. A lower limit of the atomic molar ratio $O_{FeO}/C_{fix}$ is preferably 0.9 or more, more preferably 1.0 or more, and further more preferably 1.1 or more. An upper limit of the atomic molar ratio $O_{FeO}/C_{fix}$ is preferably 1.8 or less, more preferably 1.7 or less. When the amount of addition of the carbonaceous reducing agent is large, the strength of the agglomerate before being heated decreases, and the handling property is aggravated. On the other hand, when the amount of addition of the carbonaceous reducing agent is small, reduction of the iron oxide becomes insufficient, and the yield of reduced iron decreases. Here, the yield of reduced iron refers to the mass ratio of reduced iron having a diameter of 3.35 mm or more with respect to the total mass of iron contained in the agglomerate, and is calculated by [(mass of reduced iron having a diameter of 3.35 mm or more/total mass of iron contained in the agglomerate)×100].

An upper limit of the average particle diameter of the carbonaceous reducing agent is preferably 1000 μm or less, more preferably 700 μm or less, and further more preferably 500 μm or less. When the average particle diameter is 1000 μm or less, reduction of the iron oxide contained in the iron oxide-containing substance can be allowed to proceed evenly. A lower limit of the average particle diameter is preferably 100 μm or more, more preferably 150 μm or more, and further more preferably 200 μm. The average particle diameter means a 50% volume particle diameter.

For the particles having a particle diameter of 710 μm or more in the carbonaceous reducing agent, a value obtained by measuring the particle size distribution with use of a standard sieve defined in JIS is used. For the particles having a particle diameter of less than 710 μm, a value obtained by measuring with use of a laser diffraction type particle size distribution measurement apparatus (Microtrack FRA9220 manufactured by Leads and Northrup Co.) is used.

Conventionally, it was believed that the average particle diameter of the carbonaceous reducing agent affects the productivity of reduced iron. However, the present inventors have found out that the particle diameter distribution affects the productivity of reduced iron rather than the average particle diameter of the carbonaceous reducing agent. In other words, the present inventors have found out that, whether the average particle diameter of the carbonaceous reducing agent is large or small, it does not give a large influence on the yield of reduced iron, but rather, reduction of the ratio of particles having a particle diameter of 105 μm or less contained in the carbonaceous reducing agent improves the yield of reduced iron. The present inventors believe that this is because the carbonaceous reducing agent made of particles having a particle diameter of 105 μm or less is filled between the particles of the carbonaceous reducing agent, and accordingly the reduced iron is less likely to be aggregated to a coarse size of 3.35 mm or more.

For this reason, the mass percentage $X_{under105}$ of particles having a particle diameter of 105 μm or less with respect to the total mass of particles configuring the carbonaceous reducing agent is preferably 65 mass % or less, more preferably 50 mass % or less, and further more preferably 25 mass % or less. On the other hand, $X_{under105}$ is preferably 1 mass % or more, more preferably 3 mass % or more, and further more preferably 5 mass % or more. The particle diameter distribution of the carbonaceous reducing agent can be obtained by using the same measurement apparatus as the one used for measuring the average particle diameter thereof.

Further, the mass percentage $X_{120\text{-}250}$ of particles having a particle diameter of 120 μm or more to 250 μm or less with respect to the total mass of particles configuring the carbonaceous reducing agent is preferably 30 mass % or more to 80 mass % or less. When particles having the above particle diameter are contained at the above mass percentage, suitable voids are generated between the particles of the carbonaceous reducing agent. Further, reduced iron flows into such voids and are aggregated with each other, whereby coarse reduced iron can be produced. When the mass percentage of the particles having a particle diameter exceeding 250 μm increases, the agglomerates are less likely to be agglomerated. When the ratio of particles having a particle diameter of less than 120 μm increases, the reduced iron tends to become finer. The ratio $X_{120-250}$ is preferably 45 mass % or more, more preferably 50 mass % or more. Also, the ratio $X_{120-250}$ is preferably 75 mass % or less.

<Melting-Point Adjuster>

The melting-point adjuster is a component that performs a function of lowering the melting point of gangue in the iron oxide-containing substance and the melting point of ash in the carbonaceous reducing agent. When such a melting-point adjuster is blended, the gangue is melted to become a molten slag at the time of heating. Part of the iron oxide is dissolved into this molten slag and is reduced in the molten slag to become metal iron. This metal iron, in a state of solid as it is, is brought into contact with reduced metal iron and is aggregated as solid metal iron.

The melting-point adjuster that can be used may be, for example, a CaO-supplying substance, an MgO-supplying substance, an $SiO_2$-supplying substance, or the like. The CaO-supplying substance that can be used may be one or more selected from the group consisting of CaO (quicklime), $Ca(OH)_2$ (hydrated lime), $CaCO_3$ (limestone), and $CaMg(CO_3)_2$ (dolomite). The MgO-supplying substance may be, for example, MgO powder, an Mg-containing substance extracted from natural ore, sea water or the like, $MgCO_3$, or the like. The $SiO_2$-supplying substance may be, for example, $SiO_2$ powder, silica sand, or the like.

The melting-point adjuster is preferably pulverized in advance before being mixed. The melting-point adjuster is preferably pulverized so as to have an average particle diameter of 5 μm or more to 90 μm or less. A pulverizing method that can be used herein may be a method similar to that for the iron oxide-containing substance.

<Binder>

The binder that can be used may be, for example, a polysaccharide such as starch, e.g., cornstarch or wheat flour.

[Heating Step]

In the heating step, the agglomerate obtained in the agglomeration step is heated, thereby to produce reduced iron.

In the beating step, it is preferable to heat the agglomerate to a temperature of 1300° C. or higher to 1500° C. or lower by charging the agglomerate into a heating furnace and heating the inside of the furnace. When the heating temperature is 1300° C. or higher, metal iron is readily melted, thereby enhancing the productivity. When the heating temperature is 1500° C. or lower, rise in the temperature of discharged gas is suppressed, whereby costs for the discharged gas treatment equipment can be suppressed.

Before the agglomerate is charged into the heating furnace, it is preferable to protect the hearth by spreading a bed mat on the hearth. The bed mat may be, for example, carbonaceous, refractory ceramics, refractory particles, or materials used in the above-described carbonaceous reducing agent. The material configuring the bed mat that is used here preferably has a particle diameter of 0.5 mm or more to 3 mm or less. When the particle diameter is 0.5 mm or more, leaping of the bed mat caused by combustion gas of a burner in the furnace can be suppressed. When the particle diameter is 3 mm or less, the agglomerate or a molten product thereof is less liable to go into the bed mat.

An electric furnace or a moving-hearth type heating furnace is preferably used as the heating furnace. The moving-hearth type heating furnace is a heating furnace in which the hearth moves as a conveyor belt in the furnace, and may be, for example, a rotary hearth furnace, a tunnel furnace, or the like.

In the rotary hearth furnace, the appearance of the hearth is designed to have a circular shape or a doughnut shape in such a manner that the start point and the end point of the hearth are located at the same position. Iron oxide contained in the agglomerates that are charged onto the hearth is reduced by being heated to produce reduced iron while the agglomerates make a circuit in the furnace. Thus, the rotary hearth furnace is equipped with a charging means for charging the agglomerates into the furnace at the upstream end in the direction of rotation and a discharging means at the downstream end in the direction of rotation. Here, since the rotary hearth furnace has a rotational structure, the discharging means is disposed immediately upstream of the charging means. The tunnel furnace refers to a heating furnace in which a hearth moves linearly in the furnace.

[Others]

Granular metal iron obtained in the above granulation step is discharged together with the slag produced as a by-product, the bed mat that is spread in accordance with the needs, and the like from the furnace. The granular metal iron thus discharged may be sorted with use of a sieve or a magnetic separator, whereby reduced iron having a desired size can be collected. In the aforementioned manner, reduced iron can be manufactured.

The reduced iron manufacturing method of the present invention described above has high productivity of reduced iron.

In the present invention, since Expression (I) as above is satisfied, the mass percentage $O_{FeO}$ of oxygen contained in the iron oxide in the agglomerate, the mass percentage $C_{fix}$ of the total fixed carbon contained in the agglomerate, and the mass percentage $X_{under105}$ of particles having a particle diameter of 105 μm or less are in suitable ratios, whereby the yield of reduced iron can be improved, and the productivity of reduced iron can be enhanced.

In the present invention, when $X_{under105}$ is 1 mass % or more to 65 mass % or less, the reduced iron readily penetrates between the particles of the carbonaceous reducing agent, and aggregation of the reduced iron can be promoted.

In the present invention, when the mass percentage of particles having a particle diameter of 120 μm or more to 250 μm or less with respect to the total mass of particles configuring the carbonaceous reducing agent is 30 mass % or more to 80 mass % or less, the iron oxide in the iron oxide-containing substance can be efficiently reduced, and also the reduced iron is readily aggregated with each other to have a large size.

EXAMPLES

Hereafter, the present invention will be described in more detail by way of Examples, but the present invention is not limited by these Examples.

Examples 1 to 8 and Comparative Examples 1 to 5

A mixture was prepared by blending an iron ore (iron oxide-containing substance), coal (carbonaceous reducing agent), limestone (melting-point adjuster), and wheat flour (binder) at blending ratios shown in Table 1. As the coal, eleven types (A-1 to A-7 and B-1 to B-4) having different particle diameter distributions and compositions as shown in the later-given Tables 2 and 3 were used. Into the mixture, a suitable amount of water was added, and raw pellets (agglomerates) having a size of ϕ19 mm were granulated with use of a tire-type granulator. These raw pellets were dried by being heated at 180° C. for one hour with use of a dryer, so as to obtain dried pellets.

Next, in order to protect the hearth of the heating furnace, a carbon material (anthracite) having a maximum particle diameter of 2 mm or less was placed on the hearth of the heating furnace, and the dried pellets were placed on the carbon material. Further, the inside of the heating furnace was heated at 1450° C. for 11.5 minutes while a mixed gas containing 40 vol % of nitrogen gas and 60 vol % of carbon dioxide gas was being introduced into the heating furnace at a gas flow rate of 220 NL/minute, so as to reduce the iron oxide to prepare heated pellets. Here, it has been confirmed that the values of the yield and the powder generation ratio mentioned later do not change even when the component and the flow rate of the mixed gas that is introduced into the heating furnace is changed.

After the heated pellets were taken out from the heating furnace and subjected to magnetic separation, the heated pellets were sifted with use of a sieve having an opening of 3.35 mm, so as to collect reduced iron having a size of 3.35 mm or more in diameter.

TABLE 1

| Component | Raw material | Examples 1 | 2 | 3 | 4 | 5 | 6 | 7 | 8 |
|---|---|---|---|---|---|---|---|---|---|
| Iron oxide-containing substance (mass %) | Iron ore | 65.397 | 65.397 | 65.397 | 65.397 | 64.565 | 63.755 | 72.725 | 72.521 |
| Carbonaceous reducing agent (mass %) | Coal Type | 23.515 A-2 | 23.515 A-3 | 23.515 A-5 | 23.515 A-7 | 25.312 A-2 | 26.356 A-2 | 17.005 B-3 | 17.143 B-4 |
| Melting-point adjuster (mass %) | Limestone | 10.188 | 10.188 | 10.188 | 10.188 | 9.224 | 8.989 | 9.370 | 9.436 |
| Binder (mass %) | Wheat flour | 0.9 | 0.9 | 0.9 | 0.9 | 0.9 | 0.9 | 0.9 | 0.9 |
| Total fixed carbon amount (mass %) $C_{fix}$ | | 12.02 | 12.06 | 11.35 | 11.93 | 12.93 | 13.46 | 13.26 | 13.23 |
| Oxygen amount in iron oxide (mass %) $O_{FeO}$ | | 17.50 | 17.49 | 17.53 | 17.52 | 17.28 | 17.07 | 19.46 | 19.41 |
| Mass percentage of 150 μm or less (mass %) $X_{under105}$ | | 23.04 | 3.69 | 61.52 | 52.7 | 23.04 | 23.04 | 48.71 | 20.65 |
| Mass percentage of 120 to 250 μm (mass %) $X_{120\text{-}250}$ | | 73.51 | 52.19 | 36.76 | 33.33 | 73.51 | 73.51 | 51.00 | 39.76 |
| Expression (I) $C_{fix} \times X_{under105}/O_{FeO}$ | | 15.8 | 2.5 | 39.8 | 35.9 | 17.2 | 18.2 | 33.2 | 14.1 |
| Iron yield (mass %) | | 98.5 | 97.9 | 99.3 | 102.7 | 104.0 | 102.9 | 93.5 | 97.0 |
| Powder generation ratio (mass %) | | 4.2 | 3.9 | 3.7 | 0.4 | 0.0 | 2.3 | 9.7 | 5.8 |

| Component | Raw material | Comparative Examples 1 | 2 | 3 | 4 | 5 |
|---|---|---|---|---|---|---|
| Iron oxide-containing substance (mass %) | Iron ore | 65.397 | 65.397 | 65.397 | 72.355 | 72.458 |
| Carbonaceous reducing agent (mass %) | Coal Type | 23.515 A-1 | 23.515 A-4 | 23.515 A-6 | 17.229 B-1 | 17.106 B-2 |
| Melting-point adjuster (mass %) | Limestone | 10.188 | 10.188 | 10.188 | 9.516 | 9.535 |
| Binder (mass %) | Wheat flour | 0.9 | 0.9 | 0.9 | 0.9 | 0.9 |
| Total fixed carbon amount (mass %) $C_{fix}$ | | 10.69 | 10.95 | 11.93 | 13.22 | 13.22 |

TABLE 1-continued

| | | | | | |
|---|---|---|---|---|---|
| Oxygen amount in iron oxide (mass %) $O_{FeO}$ | 17.56 | 17.55 | 17.52 | 19.41 | 19.40 |
| Mass percentage of 150 μm or less (mass %) $X_{under105}$ | 100.00 | 84.61 | 82.19 | 99.92 | 85.16 |
| Mass percentage of 120 to 250 μm (mass %) $X_{120\text{-}250}$ | 0.00 | 14.70 | 16.96 | 0.08 | 14.84 |
| Expression (I) $C_{fix} \times X_{under105}/O_{FeO}$ | 60.9 | 52.8 | 56.0 | 68.1 | 58.0 |
| Iron yield (mass %) | 75.9 | 75.8 | 76.3 | 71.5 | 77.5 |
| Powder generation ratio (mass %) | 26.0 | 26.6 | 26.1 | 30.5 | 25.6 |

The "mass percentage $C_{fix}$ of the total fixed carbon amount" in Table 1 is a total mass percentage (%) of the fixed carbon contained in the carbonaceous reducing agent and the binder in the pellets. As the fixed carbon contained in the carbonaceous reducing agent and the binder, a value calculated by the fixed carbon mass fraction calculation method defined in JIS M8812 was adopted.

The "oxygen amount $O_{FeO}$ in iron oxide" in Table 1 is a total mass percentage (%) of the mass percentage of oxygen contained in iron oxide in the iron oxide-containing substance and the mass percentage of oxygen contained in iron oxide in the ash among the components of the carbonaceous reducing agent. The mass percentage of oxygen contained in iron oxide in the iron oxide-containing substance was calculated by a sum of the mass percentages of oxygen contained in magnetite ($Fe_3O_4$) and hematite ($Fe_2O_3$) in the iron oxide-containing substance. Details of the calculation method will be described later. The ratio of ash contained in the carbonaceous reducing agent was quantitated by the ash quantitation method defined in JIS M8812.

The "mass percentage (%) $X_{under105}$ of 105 μm or less" in Table 1 is a mass percentage (%) of the particles having a particle diameter of 105 μm or less with respect to the total mass of the particles configuring the carbonaceous reducing agent. This mass percentage was calculated by measuring the particle size distribution of the particles configuring the carbonaceous reducing agent with use of a laser diffraction type particle size distribution measurement apparatus (Microtrack FRA9220 manufactured by Leads and Northrup Co.).

The "mass percentage (%) $X_{120\text{-}250}$ of 120 to 250 μm" in Table 1 is a mass percentage (%) of the particles having a particle diameter of 120 to 250 μm with respect to the total mass of the particles configuring the carbonaceous reducing agent. This mass percentage was calculated by measuring with use of the above laser diffraction type particle size distribution measurement apparatus.

The "Expression (I) $C_{fix} \times X_{under105}/O_{FeO}$" in Table 1 is a value calculated by substituting the mass percentage $C_{fix}$ of the total fixed carbon amount, the mass percentage $O_{FeO}$ of oxygen contained in the iron oxide, and $X_{under105}$ respectively into Expression (I).

The "iron yield" in Table 1 is a mass ratio of reduced iron on the sieve with respect to the total mass of iron in the pellets charged into the heating furnace and is a value calculated by the following expression as follows. It is shown that, the higher the iron yield is, the higher the productivity is.

Yield (%)=((mass of reduced iron on the sieve)/(total mass of iron in the pellets charged into the heating furnace))×100

The "powder generation ratio" in Table 1 is a mass ratio of fine powder iron that did not stay on the sieve with respect to the total mass of iron in the pellets that were charged into the heating furnace and is a value calculated by the following expression. It is shown that, the lower the powder generation ratio is, the higher the productivity is.

Powder generation ratio (%)=(((total mass of iron in the pellets charged into the heating furnace)−(mass of fine powder iron in reduced iron on the sieve))/(total mass of iron in the pellets charged into the heating furnace))×100

Figure 2:
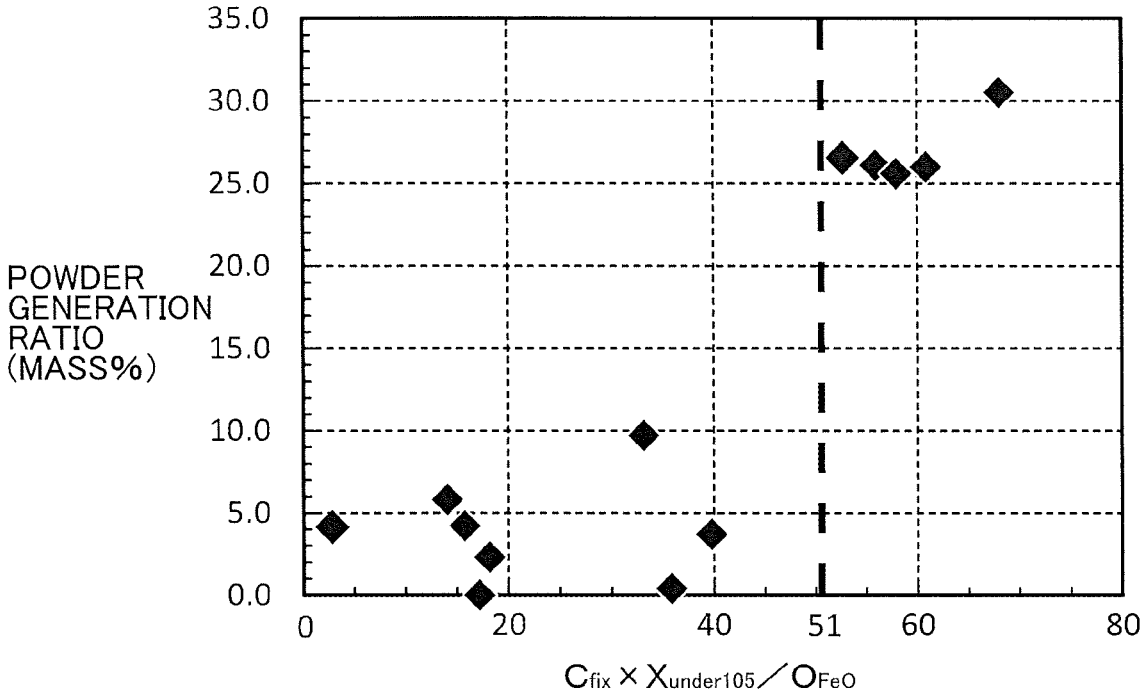
FIG. 2 is a graph showing correlation between $C_{fix} \times X_{under105}/O_{FeO}$ and powder generation ratio (mass %) of each of the Examples and Comparative Examples, where the longitudinal axis represents the powder generation ratio (mass %) and the lateral axis represents $C_{fix} \times X_{under105}/O_{FeO}$.

FIG. 1 is a graph showing correlation between $C_{fix} \times X_{under105}/O_{FeO}$ and iron yield (mass %) of each of the Examples and Comparative Examples, and FIG. 2 is a graph showing correlation between $C_{fix} \times X_{under105}/O_{FeO}$ and powder generation ratio (mass %) of each of the Examples and Comparative Examples.

From the results shown in FIGS. 1 and 2 and Table 1, it will be understood that, with the manufacturing method of Examples 1 to 8 in which the value on the left side of Expression (I) is 51 or smaller, the iron yield is 90 mass % or more, and the powder generation ratio is 10 mass % or less. In contrast, with the manufacturing method of Comparative Examples 1 to 5 in which the value on the left side of Expression (I) exceeds 51, the iron yield is less than 80 mass %, and the powder generation ratio exceeds 20 mass %. From this result, it has been made clear that the reduced iron can be manufactured at high productivity when the value on the left side of Expression (I) is set to be 51 or smaller, thereby showing the advantageous effect of the present invention.

Figure 3:
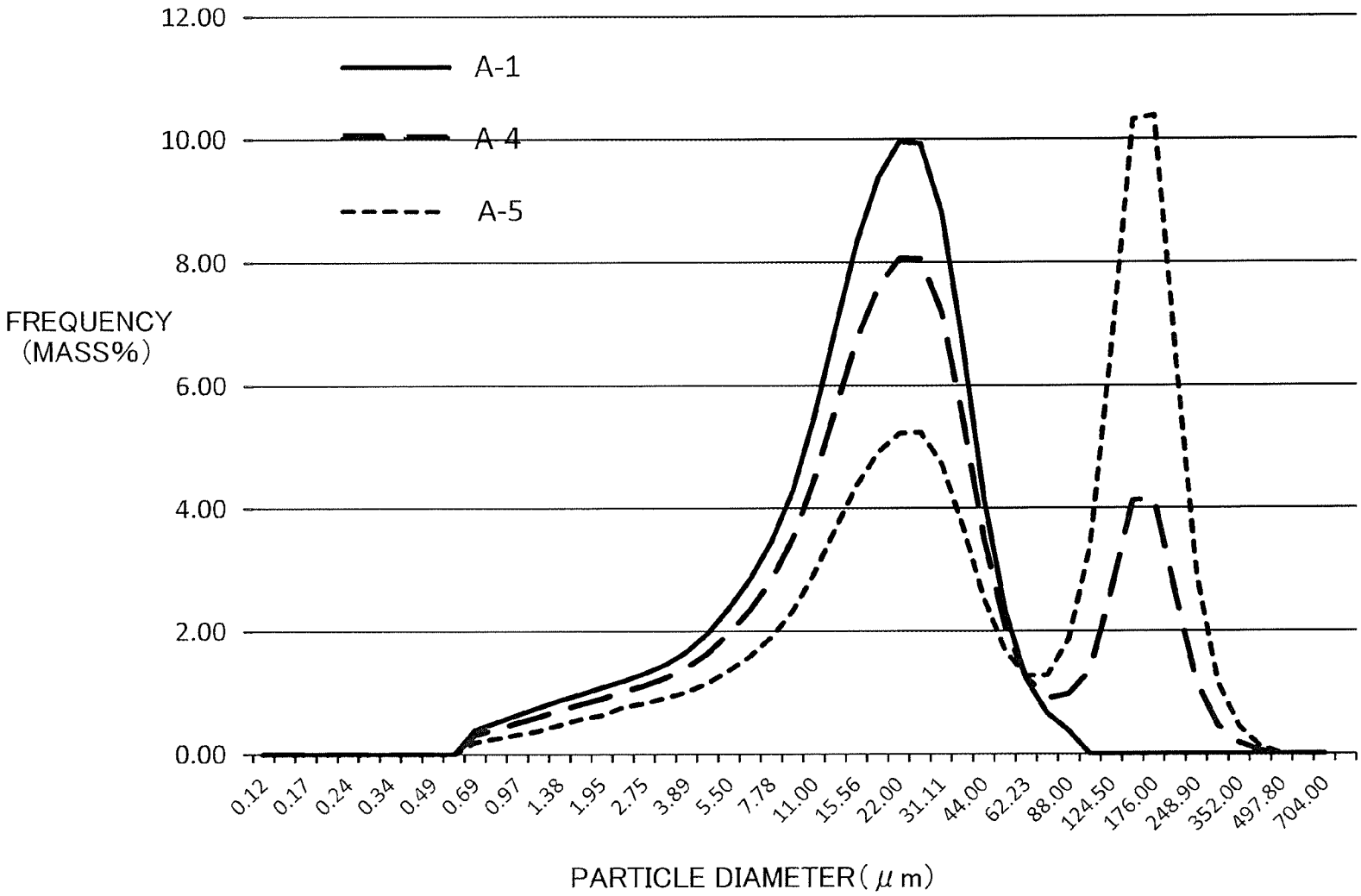
FIG. 3 is a particle diameter distribution of coal used in Example 3 (A-5), Comparative Example 1 (A-1), and Comparative Example 2 (A-4), where the longitudinal axis represents the frequency (mass %) and the lateral axis represents the particle diameter (μm).
Figure 4:
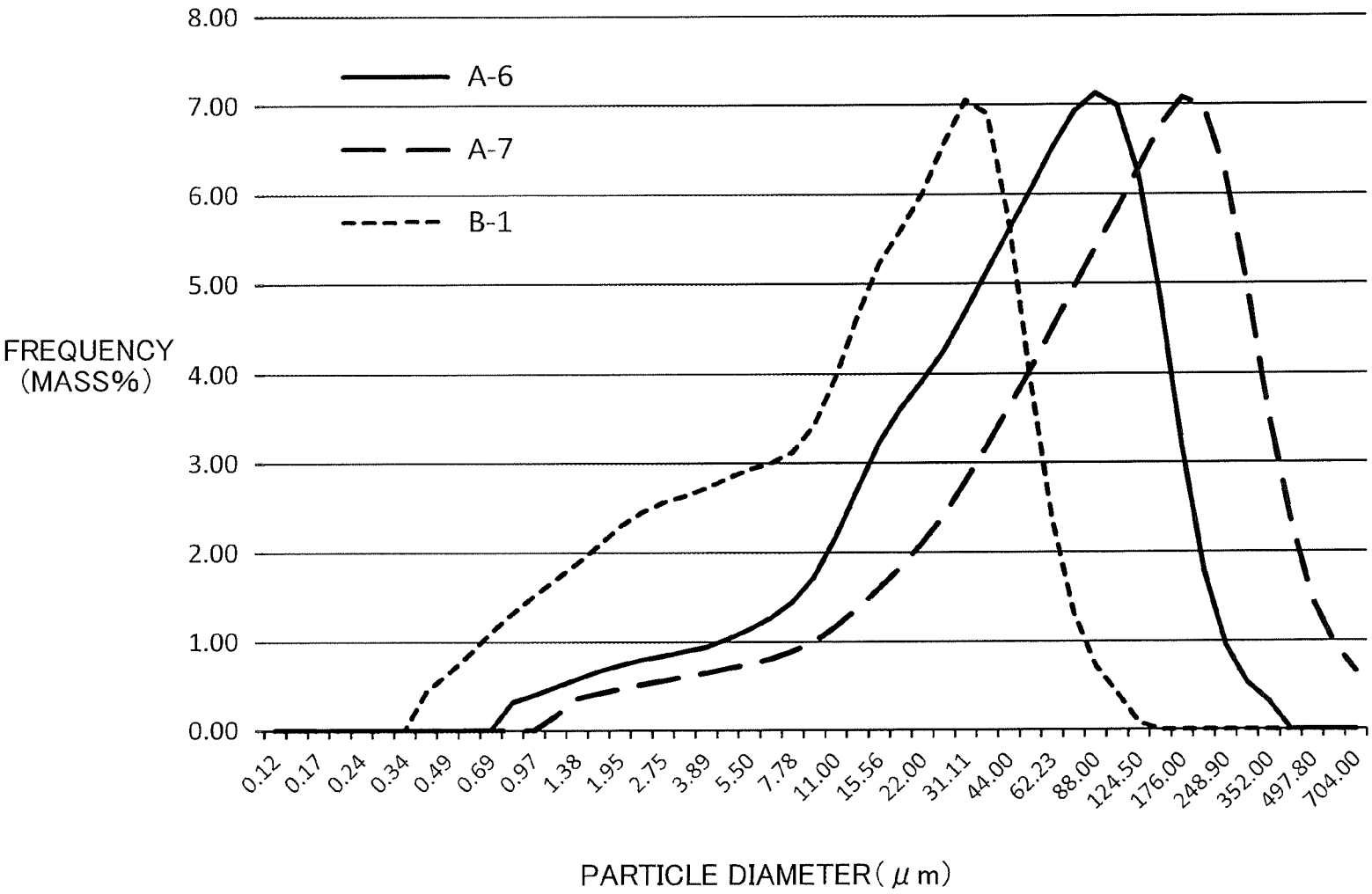
FIG. 4 is a particle diameter distribution of coal used in Example 4 (A-7), Comparative Example 3 (A-6), and Comparative Example 4 (B-1), where the longitudinal axis represents the frequency (mass %) and the lateral axis represents the particle diameter (μm).
Figure 5:
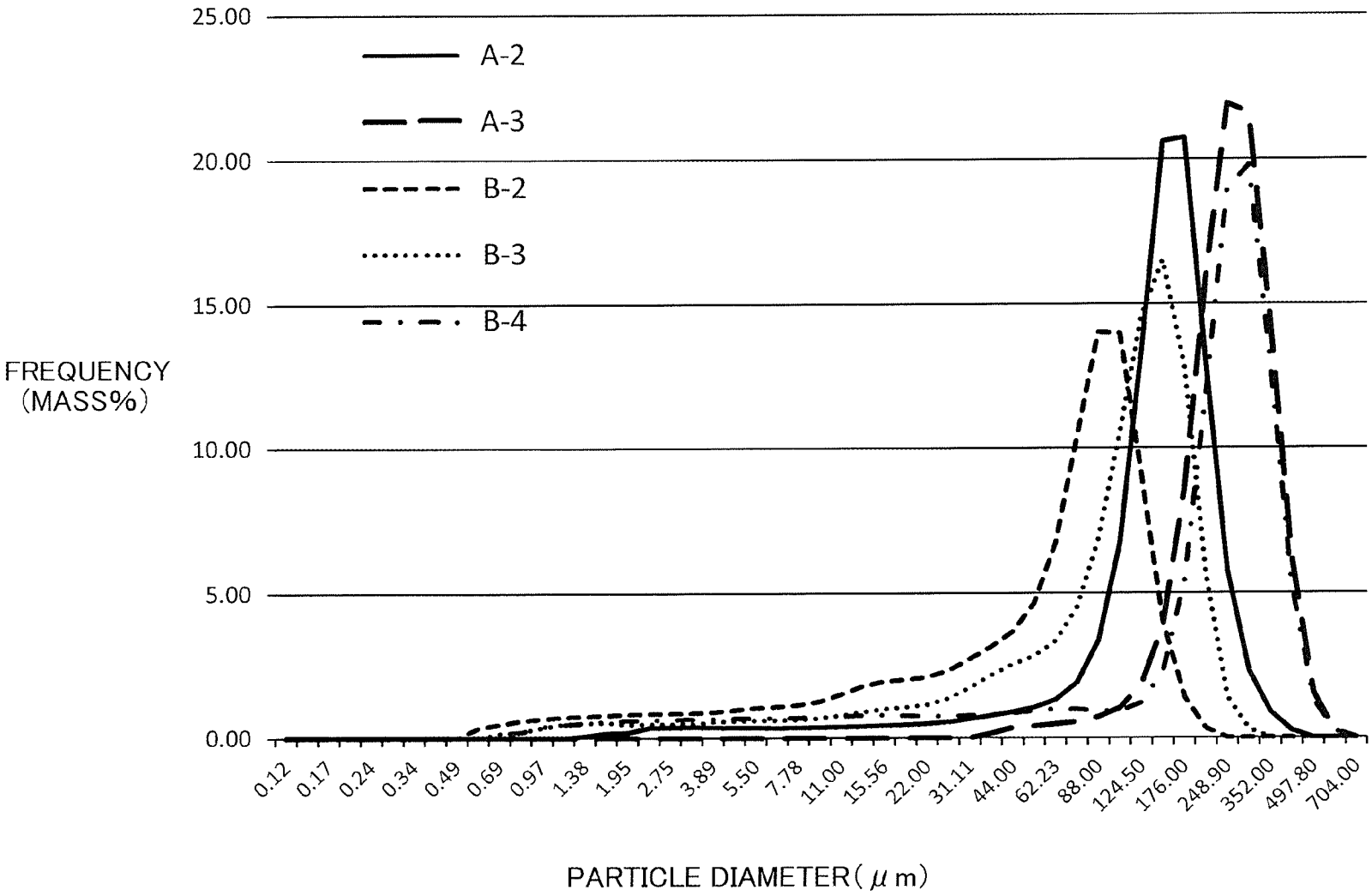
FIG. 5 is a particle diameter distribution of coal used in Example 1 (A-2), Example 2 (A-3), Example 7 (B-3), Example 8 (B-4), and Comparative Example 5 (B-2), where the longitudinal axis represents the frequency (mass %) and the lateral axis represents the particle diameter (μm).

FIGS. 3 to 5 are graphs of a particle size distribution of coal in A-1 to A-7 and B-1 to B-4. FIG. 3 shows a particle diameter distribution of coal in which the particle diameter distribution assumes two summits. FIG. 4 shows a particle diameter distribution of coal in which the shapes of the summit of the particle diameter distributions are similar though the average particle diameter differs. FIG. 5 shows a particle diameter distribution of coal in which the average particle diameter assumes one summit. As shown in FIGS. 3 to 5, it will be understood that there are a case in which the productivity of reduced iron is high and a case in which the productivity of reduced iron is low, irrespective of whether the shape of the particle diameter distribution assumes one summit or two summits. From this, it has been shown that the mass percentage of particles having a particle diameter of 105 μm or less with respect to the total mass of particles configuring the carbonaceous reducing agent is important rather than whether the shape of the particle diameter distribution assumes one summit or two summits.

Here, the following were used as the raw materials contained in the agglomerate in Table 1.

<Iron Ore (Iron Oxide-Containing Substance)>

A hematite-based iron ore having a component composition containing 62.52 mass % of iron (T.Fe), 1.51 mass % of FeO, 5.98 mass % of $SiO_2$, 0.82 mass % of $Al_2O_3$, 0.10 mass % of CaO, and 0.07 mass % of MgO was used as the iron oxide-containing substance. As the content of the above T.Fe and FeO, a value quantitated by the potassium dichromate titration method was adopted.

Since the iron oxide-containing substance was a hematite-based iron ore, it was assumed that FeO among the iron (T.Fe) contained in the iron oxide-containing substance existed as magnetite ($Fe_3O_4$) and the other iron existed as hematite ($Fe_2O_3$). Based on this assumption, the mass % of magnetite ($Fe_3O_4$) and hematite ($Fe_2O_3$) was calculated by the following calculation formulas.

Magnetite ($Fe_3O_4$) amount=(FeO analysis value)/(FeO molecular weight)×($Fe_3O_4$ molecular weight)

Hematite ($Fe_2O_3$) amount=((T.Fe analysis value)−($Fe_3O_4$ amount/$Fe_3O_4$ molecular weight×iron atomic weight×3))/(iron atomic weight×2)×($Fe_2O_3$ molecular weight)

Oxygen amount ($O_{FeO}$) contained in iron oxide=$Fe_2O_3$ amount×oxygen atomic weight×3+$Fe_3O_4$ amount×oxygen atomic weight×4

From the above calculation, the iron oxide contained 84.35 mass % of hematite ($Fe_2O_3$) and 4.87 mass % of magnetite ($Fe_3O_4$), and the mass percentage ($O_{FeO}$) of oxygen contained in these iron oxides was calculated to be 26.7 mass %.

<Coal (Carbonaceous Reducing Agent)>

As the carbonaceous reducing agent, eleven types of coal (A-1 to A-7 and B-1 to B-4) having different particle size distributions and compositions were used. The particle size distribution and composition of each coal are shown in Tables 2 and 3.

TABLE 2

| Particle diameter (μm) | A-1 | A-2 | A-3 | A-4 | A-5 | A-6 | A-7 | B-1 | B-2 | B-3 | B-4 |
|---|---|---|---|---|---|---|---|---|---|---|---|
| | Mass ratio (mass %) | | | | | | | | | | |
| 704.00 | 0.00 | 0.00 | 0.00 | 0.00 | 0.00 | 0.00 | 0.66 | 0.00 | 0.00 | 0.00 | 0.00 |
| 592.00 | 0.00 | 0.00 | 0.22 | 0.00 | 0.00 | 0.00 | 0.97 | 0.00 | 0.00 | 0.00 | 0.22 |
| 497.80 | 0.00 | 0.00 | 1.56 | 0.00 | 0.00 | 0.00 | 1.48 | 0.00 | 0.00 | 0.00 | 1.29 |
| 418.60 | 0.00 | 0.24 | 6.25 | 0.05 | 0.12 | 0.00 | 2.36 | 0.00 | 0.00 | 0.00 | 5.27 |
| 352.00 | 0.00 | 0.90 | 14.50 | 0.18 | 0.45 | 0.32 | 3.54 | 0.00 | 0.00 | 0.00 | 13.00 |
| 296.00 | 0.00 | 2.31 | 21.59 | 0.46 | 1.16 | 0.53 | 4.96 | 0.00 | 0.00 | 0.29 | 19.81 |
| 248.90 | 0.00 | 5.81 | 21.91 | 1.16 | 2.91 | 0.96 | 6.22 | 0.00 | 0.00 | 1.40 | 18.96 |
| 209.30 | 0.00 | 12.99 | 15.92 | 2.60 | 6.50 | 1.81 | 6.98 | 0.00 | 0.32 | 5.66 | 11.88 |
| 176.00 | 0.00 | 20.75 | 8.62 | 4.15 | 10.38 | 3.16 | 7.08 | 0.00 | 1.40 | 12.84 | 5.43 |
| 148.00 | 0.00 | 20.62 | 3.90 | 4.12 | 10.31 | 4.82 | 6.76 | 0.00 | 4.02 | 16.51 | 2.28 |
| 124.50 | 0.00 | 13.34 | 1.84 | 2.67 | 6.67 | 6.21 | 6.29 | 0.08 | 9.10 | 14.59 | 1.21 |
| 104.70 | 0.00 | 6.77 | 1.03 | 1.35 | 3.39 | 6.99 | 5.83 | 0.42 | 13.99 | 10.56 | 0.92 |
| 88.00 | 0.38 | 3.36 | 0.72 | 0.98 | 1.87 | 7.13 | 5.40 | 0.73 | 14.03 | 6.88 | 0.93 |
| 74.00 | 0.66 | 1.90 | 0.56 | 0.91 | 1.28 | 6.92 | 4.95 | 1.32 | 10.37 | 4.52 | 0.98 |
| 62.23 | 1.22 | 1.32 | 0.47 | 1.24 | 1.27 | 6.51 | 4.50 | 2.37 | 6.76 | 3.36 | 0.99 |
| 52.33 | 2.31 | 1.05 | 0.40 | 2.06 | 1.68 | 6.04 | 4.04 | 3.94 | 4.64 | 2.83 | 0.93 |
| 44.00 | 4.15 | 0.90 | 0.35 | 3.50 | 2.53 | 5.60 | 3.62 | 5.69 | 3.68 | 2.54 | 0.86 |
| 37.00 | 6.63 | 0.77 | 0.16 | 5.46 | 3.70 | 5.14 | 3.19 | 6.90 | 3.16 | 2.17 | 0.80 |
| 31.11 | 8.81 | 0.65 | 0.00 | 7.18 | 4.73 | 4.69 | 2.79 | 7.05 | 2.73 | 1.74 | 0.77 |
| 26.16 | 9.93 | 0.55 | 0.00 | 8.05 | 5.24 | 4.26 | 2.41 | 6.57 | 2.33 | 1.37 | 0.75 |
| 22.00 | 9.95 | 0.49 | 0.00 | 8.06 | 5.22 | 3.92 | 2.10 | 6.01 | 2.10 | 1.15 | 0.75 |
| 18.50 | 9.37 | 0.45 | 0.00 | 7.59 | 4.91 | 3.61 | 1.83 | 5.60 | 2.01 | 1.06 | 0.77 |
| 15.56 | 8.32 | 0.43 | 0.00 | 6.74 | 4.38 | 3.22 | 1.60 | 5.22 | 1.95 | 1.00 | 0.79 |
| 13.08 | 6.92 | 0.40 | 0.00 | 5.62 | 3.66 | 2.70 | 1.37 | 4.64 | 1.78 | 0.90 | 0.78 |
| 11.00 | 5.49 | 0.38 | 0.00 | 4.47 | 2.94 | 2.17 | 1.17 | 3.97 | 1.51 | 0.78 | 0.74 |
| 9.25 | 4.29 | 0.36 | 0.00 | 3.50 | 2.33 | 1.73 | 1.00 | 3.42 | 1.27 | 0.68 | 0.71 |
| 7.78 | 3.46 | 0.35 | 0.00 | 2.84 | 1.91 | 1.45 | 0.89 | 3.12 | 1.14 | 0.63 | 0.69 |
| 6.54 | 2.86 | 0.34 | 0.00 | 2.36 | 1.60 | 1.27 | 0.81 | 3.00 | 1.08 | 0.61 | 0.69 |
| 5.50 | 2.38 | 0.35 | 0.00 | 1.97 | 1.37 | 1.14 | 0.75 | 2.93 | 1.04 | 0.60 | 0.68 |
| 4.63 | 1.97 | 0.35 | 0.00 | 1.65 | 1.16 | 1.03 | 0.70 | 2.83 | 0.97 | 0.58 | 0.67 |
| 3.89 | 1.67 | 0.36 | 0.00 | 1.41 | 1.02 | 0.94 | 0.65 | 2.72 | 0.90 | 0.56 | 0.65 |
| 3.27 | 1.46 | 0.37 | 0.00 | 1.24 | 0.92 | 0.89 | 0.61 | 2.63 | 0.86 | 0.48 | 0.64 |
| 2.75 | 1.31 | 0.36 | 0.00 | 1.12 | 0.84 | 0.84 | 0.56 | 2.56 | 0.85 | 0.48 | 0.63 |
| 2.31 | 1.19 | 0.35 | 0.00 | 1.02 | 0.77 | 0.80 | 0.52 | 2.45 | 0.84 | 0.48 | 0.62 |
| 1.95 | 1.09 | 0.18 | 0.00 | 0.91 | 0.64 | 0.74 | 0.47 | 2.29 | 0.82 | 0.47 | 0.60 |
| 1.64 | 0.98 | 0.17 | 0.00 | 0.82 | 0.58 | 0.67 | 0.42 | 2.08 | 0.79 | 0.54 | 0.57 |
| 1.38 | 0.88 | 0.08 | 0.00 | 0.72 | 0.48 | 0.58 | 0.36 | 1.88 | 0.75 | 0.52 | 0.52 |
| 1.16 | 0.76 | 0.00 | 0.00 | 0.61 | 0.38 | 0.49 | 0.16 | 1.70 | 0.72 | 0.49 | 0.46 |
| 0.97 | 0.64 | 0.00 | 0.00 | 0.51 | 0.32 | 0.40 | 0.00 | 1.52 | 0.67 | 0.36 | 0.40 |
| 0.82 | 0.52 | 0.00 | 0.00 | 0.42 | 0.26 | 0.32 | 0.00 | 1.32 | 0.59 | 0.21 | 0.20 |
| 0.69 | 0.40 | 0.00 | 0.00 | 0.32 | 0.20 | 0.00 | 0.00 | 1.10 | 0.48 | 0.16 | 0.16 |
| 0.58 | 0.00 | 0.00 | 0.00 | 0.00 | 0.00 | 0.00 | 0.00 | 0.86 | 0.35 | 0.00 | 0.00 |
| 0.49 | 0.00 | 0.00 | 0.00 | 0.00 | 0.00 | 0.00 | 0.00 | 0.64 | 0.00 | 0.00 | 0.00 |
| 0.41 | 0.00 | 0.00 | 0.00 | 0.00 | 0.00 | 0.00 | 0.00 | 0.44 | 0.00 | 0.00 | 0.00 |
| 0.34 | 0.00 | 0.00 | 0.00 | 0.00 | 0.00 | 0.00 | 0.00 | 0.00 | 0.00 | 0.00 | 0.00 |
| 0.29 | 0.00 | 0.00 | 0.00 | 0.00 | 0.00 | 0.00 | 0.00 | 0.00 | 0.00 | 0.00 | 0.00 |
| 0.24 | 0.00 | 0.00 | 0.00 | 0.00 | 0.00 | 0.00 | 0.00 | 0.00 | 0.00 | 0.00 | 0.00 |
| 0.20 | 0.00 | 0.00 | 0.00 | 0.00 | 0.00 | 0.00 | 0.00 | 0.00 | 0.00 | 0.00 | 0.00 |
| 0.17 | 0.00 | 0.00 | 0.00 | 0.00 | 0.00 | 0.00 | 0.00 | 0.00 | 0.00 | 0.00 | 0.00 |

TABLE 2-continued

| Particle diameter (μm) | A-1 | A-2 | A-3 | A-4 | A-5 | A-6 | A-7 | B-1 | B-2 | B-3 | B-4 |
|---|---|---|---|---|---|---|---|---|---|---|---|
| | Mass ratio (mass %) | | | | | | | | | | |
| 0.15 | 0.00 | 0.00 | 0.00 | 0.00 | 0.00 | 0.00 | 0.00 | 0.00 | 0.00 | 0.00 | 0.00 |
| 0.12 | 0.00 | 0.00 | 0.00 | 0.00 | 0.00 | 0.00 | 0.00 | 0.00 | 0.00 | 0.00 | 0.00 |

TABLE 3

| Carbonaceous reducing agent | Component composition (mass %) Total carbon T.C | Fixed carbon $C_{carbon}$ | Volatile component | Ash | T.S | Component composition of ash (mass %) $Fe_2O_3$ | $SiO_2$ | CaO | $Al_2O_3$ | S | Ratio of 105 μm or less (mass %) | Oxygen contained in iron oxide in coal (mass %) |
|---|---|---|---|---|---|---|---|---|---|---|---|---|
| A-1 | 65.53 | 45.10 | 42.21 | 12.69 | 0.738 | 11.30 | 59.25 | 1.70 | 21.00 | 0.845 | 100.00 | 0.43 |
| A-2 | 72.53 | 50.76 | 44.42 | 4.82 | 0.640 | 11.54 | 56.15 | 1.54 | 22.57 | 0.761 | 23.04 | 0.17 |
| A-3 | 73.23 | 50.93 | 44.93 | 4.14 | 0.610 | 11.72 | 54.78 | 1.46 | 23.47 | 0.581 | 3.69 | 0.15 |
| A-4 | 66.93 | 46.23 | 42.65 | 11.12 | 0.718 | 11.35 | 58.63 | 1.67 | 21.31 | 0.828 | 84.61 | 0.38 |
| A-5 | 69.03 | 47.93 | 43.32 | 8.76 | 0.689 | 11.42 | 57.70 | 1.62 | 21.79 | 0.803 | 61.52 | 0.30 |
| A-6 | 71.77 | 50.39 | 42.26 | 7.35 | 0.714 | 10.85 | 57.55 | 2.37 | 21.32 | 0.857 | 82.19 | 0.24 |
| A-7 | 71.77 | 50.39 | 42.26 | 7.35 | 0.714 | 10.85 | 57.55 | 2.37 | 21.32 | 0.857 | 52.70 | 0.24 |
| B-1 | 87.29 | 76.25 | 16.99 | 6.76 | 0.734 | 25.54 | 28.77 | 10.59 | 17.52 | 3.490 | 99.92 | 0.52 |
| B-2 | 88.30 | 76.78 | 17.39 | 5.83 | 0.738 | 19.13 | 33.36 | 11.71 | 19.49 | 3.180 | 85.16 | 0.34 |
| B-3 | 88.99 | 77.47 | 17.57 | 4.96 | 0.748 | 17.55 | 29.09 | 14.77 | 19.45 | 4.140 | 48.71 | 0.26 |
| B-4 | 88.01 | 76.66 | 17.24 | 6.10 | 0.688 | 16.32 | 30.76 | 15.70 | 19.69 | 3.660 | 20.65 | 0.30 |

Table 2 shows a frequency (mass %) with respect to each particle diameter (μm) of particles contained in the coals of A-1 to A-7 and B-1 to B-4 as measured under the following measurement conditions using a laser diffraction type particle size distribution measurement apparatus (Microtrack FRA9220 manufactured by Leads and Northrup Co.). Here, by the laser diffraction method, the particle size distribution was measured in vol %, but it was assumed that vol % is equal to mass %.

<Measurement Conditions>

Measurement method: laser diffraction/scattering type

Measurement range: 0.12 to 710 μm

Solvent: pure water

The "fixed carbon ($C_{carbon}$)", "volatile component", and "ash" in Table 3 refer to values obtained through quantitating the fixed carbon, volatile component, and ash in the coal by the fixed carbon mass fraction calculation method, volatile component quantitation method, and ash quantitation method defined in JIS M 8812. The fixed carbon ($C_{carbon}$) was calculated by subtracting the mass of the ash and volatile component from the total (100).

The components other than S ($Fe_2O_3$, $SiO_2$, CaO, $Al_2O_3$, MgO) in the component composition of the "ash" in Table 3 were quantitated by the ICP emission spectrophotometry method, and S was quantitated by the combustion infrared absorption method. Here, the "total carbon (T.C)" in Table 3 was quantitated with use of the combustion infrared absorption method as well.

The "oxygen contained in iron oxide in coal" in Table 3 is a value calculated by (ash analysis value)×($Fe_2O_3$ analysis value in ash)/100/(molecular weight of $Fe_2O_3$)×oxygen atomic weight×3.

<Limestone (Melting-Point Adjuster)>

As the melting-point adjuster, limestone having a component composition containing 0.23 mass % of $SiO_2$, 57.01 mass % of CaO, 0.16 mass % of $Al_2O_3$, and 0.17 mass % of MgO was used. Here, the component composition of the melting-point adjuster was quantitated by a method identical to that of the above carbonaceous reducing agent.

<Wheat Flour (Binder)>

As the binder, wheat flour having a component composition containing 71.77 mass % of total carbon, 9.32 mass % of fixed carbon, 90.02 mass % of volatile component, and 0.66 mass % of ash was used. Here, the component composition of the wheat flour was quantitated by a method identical to that of the above carbonaceous reducing agent.

It is to be understood that the embodiments herein disclosed are illustrative in all respects and are not limitative. The scope of the present invention is shown not by the descriptions given above but by the scope of the claims, and it is intended that all modifications equivalent to or within the scope of the claims are comprised within the scope of the present invention.

The invention claimed is:

1. A reduced iron manufacturing method, the method comprising:

agglomerating a mixture comprising an iron oxide-containing substance and a carbonaceous reducing agent, to obtain an agglomerate; and heating the agglomerate to reduce iron oxide in the agglomerate, to obtain a reduced iron, wherein Expression (I) as follows is satisfied:

$$C_{fix} \times X_{under105} / O_{FeO} \leq 51 \quad \text{(I)}$$

where $O_{FeO}$ is mass percentage of oxygen contained in the iron oxide in the agglomerate, $C_{fix}$ is mass percentage of total fixed carbon contained in the agglomerate, and $X_{under105}$ is mass percentage of particles of the carbonaceous reducing agent having a particle diameter of 105 μm or less with respect to total mass of particles of the carbonaceous reducing agent.

2. The method according to claim 1, wherein the $X_{under105}$ is 1 mass % or more and 65 mass % or less.

3. The method according to claim 2, wherein $X_{under105}$ is 1 mass % or more and 50 mass % or less.

4. The method according to claim 2, wherein $X_{under105}$ is 1 mass % or more and 25 mass % or less.

5. The method according to claim 1, wherein a mass percentage of particles of the carbonaceous reducing agent having a particle diameter of 120 μm or more and 250 μm or less with respect to a total mass of particles of the carbonaceous reducing agent is 30 mass % or more and 80 mass % or less.

6. The method according to claim 1, wherein $C_{fix} \times X_{under105}/O_{FeO}$ is 45 or less.

7. The method according to claim 1, wherein $C_{fix} \times X_{under105}/O_{FeO}$ is 40 or less.

8. The method according to claim 1, wherein $C_{fix} \times X_{under105}/O_{FeO}$ is 2.5 or more and 39.8 or less.

9. The method according to claim 1, wherein the agglomerate has a particle diameter of 5 mm or more and 50 mm or less.

10. The method according to claim 1, wherein the agglomerate has a particle diameter of 10 mm or more and 40 mm or less.

11. The method according to claim 1, wherein the iron oxide-containing substance has an average particle diameter of from 10 to 60 μm.

12. The method according to claim 1, wherein an atomic molar ratio of oxygen atoms contained in the iron oxide in the agglomerate to the total fixed carbon contained in the agglomerate is 0.8 or more and 2 or less.

13. The method according to claim 1, wherein an atomic molar ratio of oxygen atoms contained in the iron oxide in the agglomerate to the total fixed carbon contained in the agglomerate is 1.1 or more and 1.7 or less.

14. The method according to claim 1, wherein a mass percentage of particles of the carbonaceous reducing agent having a particle diameter of 120 μm or more and 250 μm or less with respect to the total mass of particles of the carbonaceous reducing agent is 50 mass % or more and 75 mass % or less.

* * * * *